US006453638B2

(12) United States Patent
Chen

(10) Patent No.: US 6,453,638 B2
(45) **Date of Patent: *Sep. 24, 2002**

(54) PRESS MOLDED DOOR WITH IMPROVED REINFORCEMENT MATERIAL AND STILE STRUCTURE

(75) Inventor: Kuei-Yung Wang Chen, Taipei (TW)

(73) Assignee: Nan Ya Plastics Corporation, Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/390,774

(22) Filed: Sep. 7, 1999

(51) Int. Cl.[7] ..... E04C 2/54

(52) U.S. Cl. ..... 52/784.15; 52/784.1; 52/784.11; 52/784.14; 52/793.1; 52/793.11; 52/800.1; 52/800.11; 52/800.12; 52/800.13; 52/802.1; 52/716.08; 52/717.01

(58) Field of Search ..... 52/784.1, 784.11, 52/784.14, 784.15, 793.1, 793.11, 800.1, 800.18, 802.1, 800.11, 800.12, 800.13, 716.8, 717.01

(56) References Cited

U.S. PATENT DOCUMENTS

| | | | | | |
|---|---|---|---|---|---|
| 2,705,820 | A | * | 4/1955 | Torrence | 52/802.1 |
| 3,339,329 | A | * | 9/1967 | Berg | 52/802.1 |
| 3,786,609 | A | * | 1/1974 | Difazio | 52/619 |
| 3,837,134 | A | * | 9/1974 | DiFazio | 52/619 |
| 4,386,482 | A | * | 6/1983 | Quinif | 52/309.9 |
| 4,514,449 | A | * | 4/1985 | Budich | 52/309.1 |
| 4,748,780 | A | * | 6/1988 | Vinther | 52/802.1 |
| 5,537,789 | A | * | 7/1996 | Minke et al. | 52/313 |
| 5,875,609 | A | * | 3/1999 | Quinif | 52/784.14 |

FOREIGN PATENT DOCUMENTS

| | | | | |
|---|---|---|---|---|
| GB | 553015 A | * | 5/1943 | 52/784.14 |

* cited by examiner

*Primary Examiner*—Lanna Mai
*Assistant Examiner*—Dennis L. Dorsey
(74) *Attorney, Agent, or Firm*—Bacon & Thomas, PLLC

(57) ABSTRACT

A press-molded door including a reinforcing structure having a plurality of hollow vertical stiffeners joined by a horizontal web, two of the stiffeners arranged on opposite edges of the reinforcing structure with a groove formed in an edge face thereof, a T-shaped stile arranged in each edge stiffener with a tongue that fits into the groove, and front and back panels arranged on opposite sides of the reinforcing structure.

3 Claims, 11 Drawing Sheets

PRESS MOLDED DOOR WITH IMPROVED REINFORCEMENT MATERIAL AND STILE STRUCTURE

BACKGROUND OF THE INVENTION

1. Field of the Invention

This invention relates to a stile structure and interior reinforcement for a press molded door, and, more particularly, to a press molded door with an improved reinforcing material and stile structure.

2. Description of the Related Art

Taiwan Utility Model application No. 84204994, entitled "An Improvement For The Assembly Structure Of Pressed-Molded Door", was applied for and granted prior to this invention. However, the subject matter of that patent suffers from drawbacks in connection with the gluing process, material used, assembly time, and size flexibility. This invention is intended to solve those problems and improve the ease of assembly.

SUMMARY OF THE INVENTION

This invention relates to a press molded door with an improved reinforcing and stile structure comprising two door panels, top, bottom, left and right structural members, and an interior reinforced material. The invention is characterized by the structure of the co-extruded, interior reinforcement which is rigid in one plane and flexible in another plane. The above mentioned interior reinforcement is made with the door panel, together, by a single mold that can reduce the assembly time, enhance the strength of door, and enhance the quality. The above mentioned reinforcement is recessed near the handle to form a closed space with two top and bottom structural members. Finally, an imitation wood grain finish is added to the door.

The above mentioned left and right structural members of this press molded door have a groove into which T-shaped left and right stiles are inserted via a compression-fit. The top and bottom structural members are combined with the two door panels to form a closed space. After that, a hole is drilled in the bottom structural member for filling the inside with polyurethane to make an imitation wood grain door.

Moreover, the press-molded door of this invention can be made to different widths according to customers' needs, by cutting two sides of the door. Furthermore, doors with various widths can be produced by arranging the left and right stiles at different widths.

BRIEF DESCRIPTION OF THE SEVERAL VIEWS OF THE DRAWINGS

The following are illustrative drawing examples of the invention.

DETAILED DESCRIPTION OF THE PREFERRED EMBODIMENTS

Figure 1:
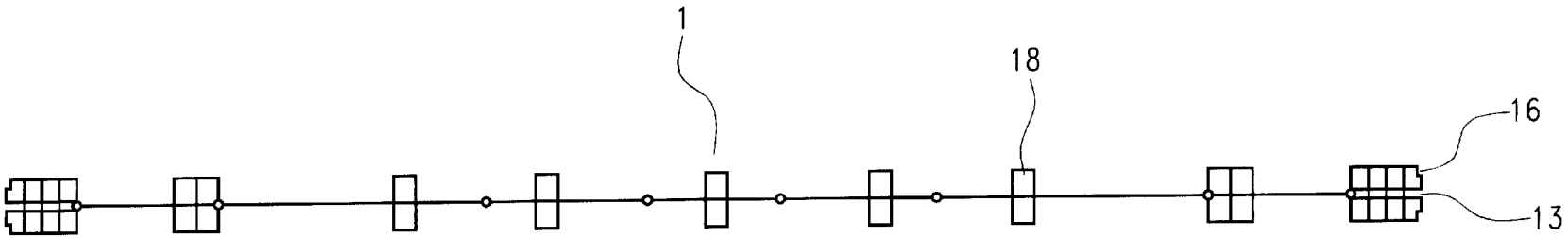
FIG. 1 is a horizontal section view of the interior reinforcing material.
Figure 3:
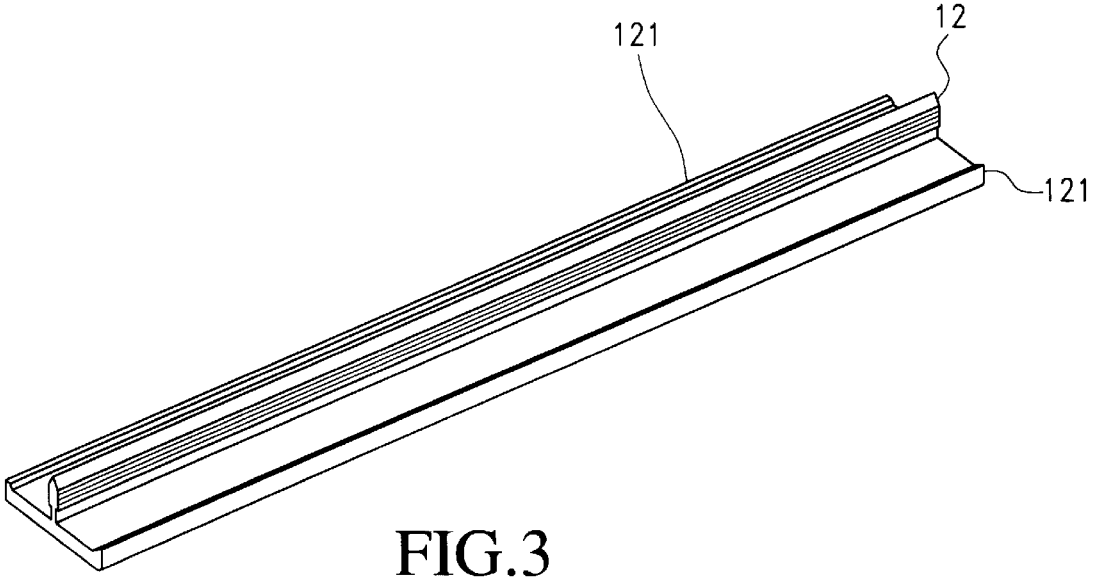
FIG. 3 is a perspective drawing of a first embodiment of left and right stiles (type 1)
Figure 4:
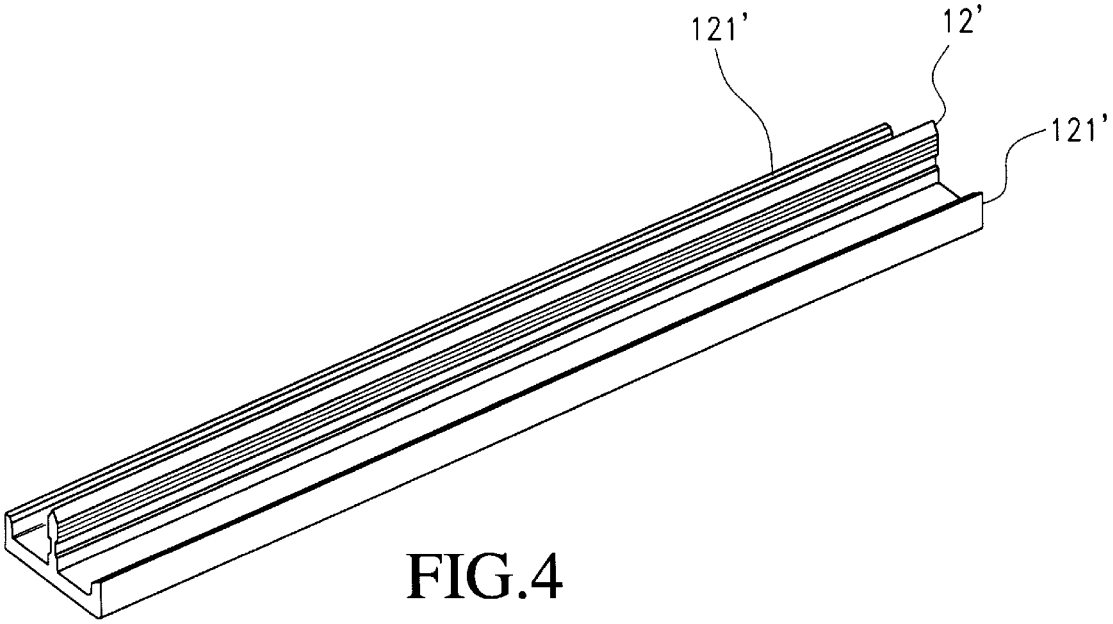
FIG. 4 is a perspective drawing of a second embodiment of left and right stiles (type 2)
Figure 7:
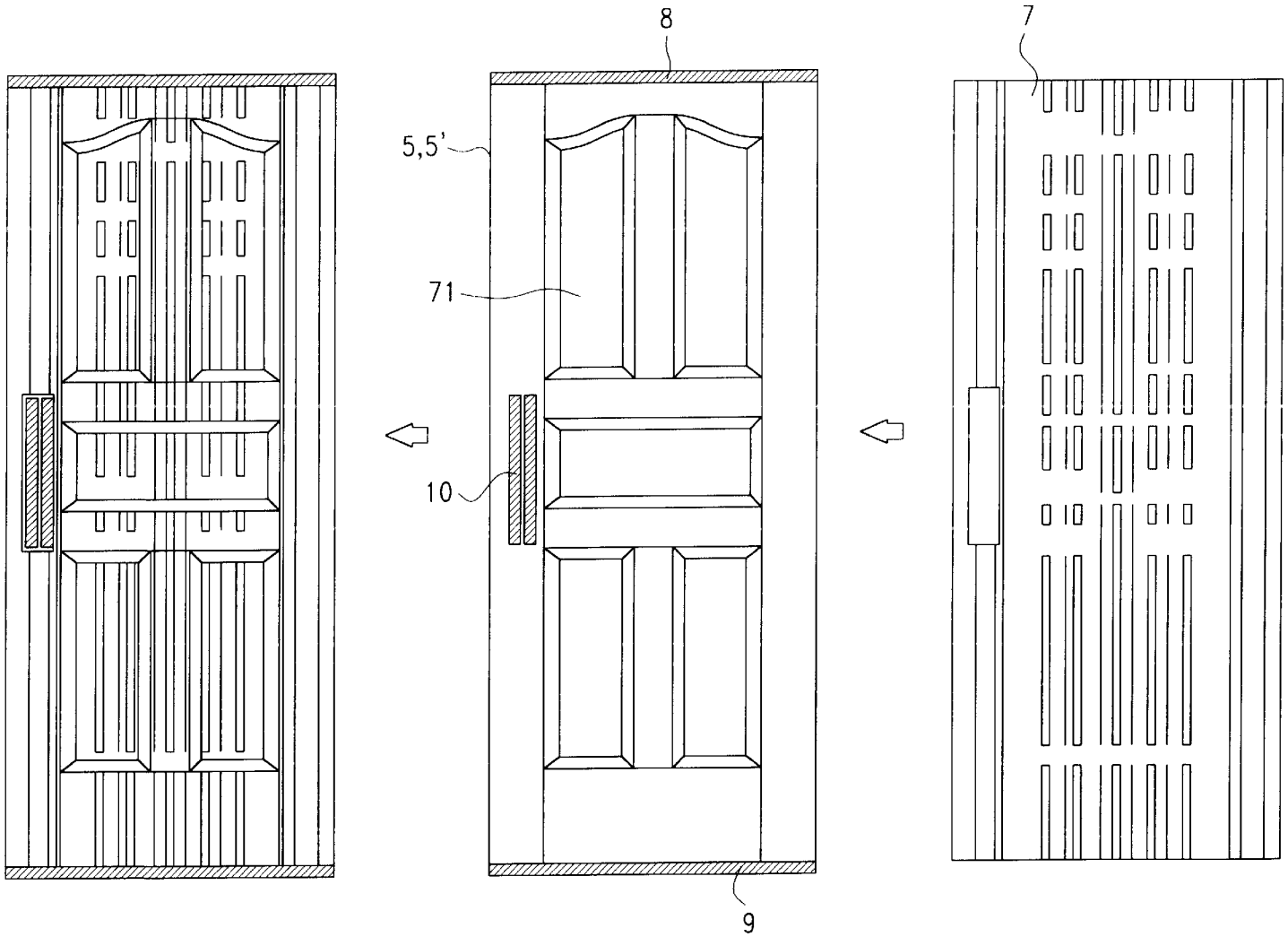
FIG. 7 shows a first embodiment of the door assembly drawing (type A) with matching door panels.
Figure 8:
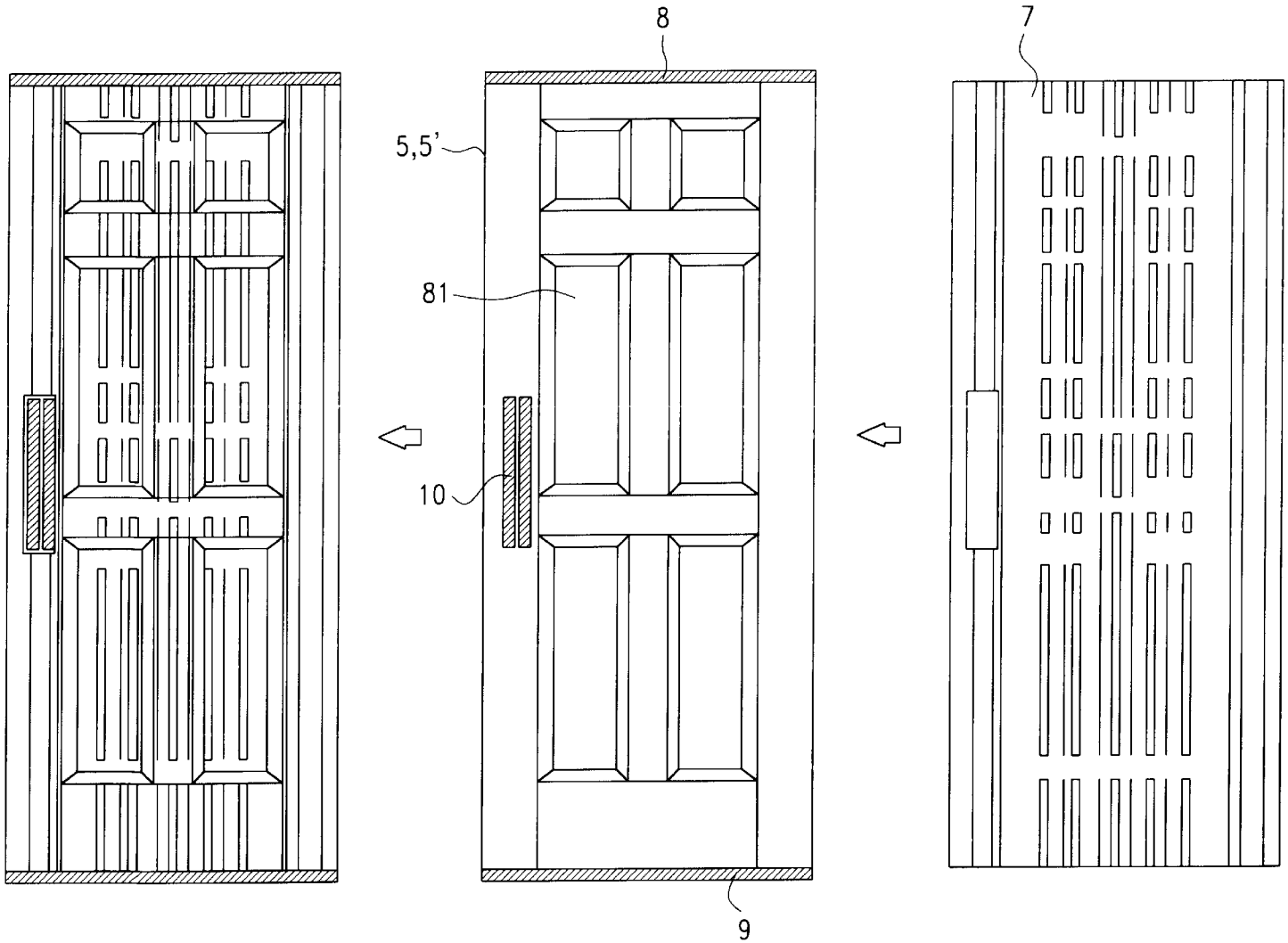
FIG. 8 shows a second embodiment of the door assembly drawing (type B) with matching door panels.
Figure 9:
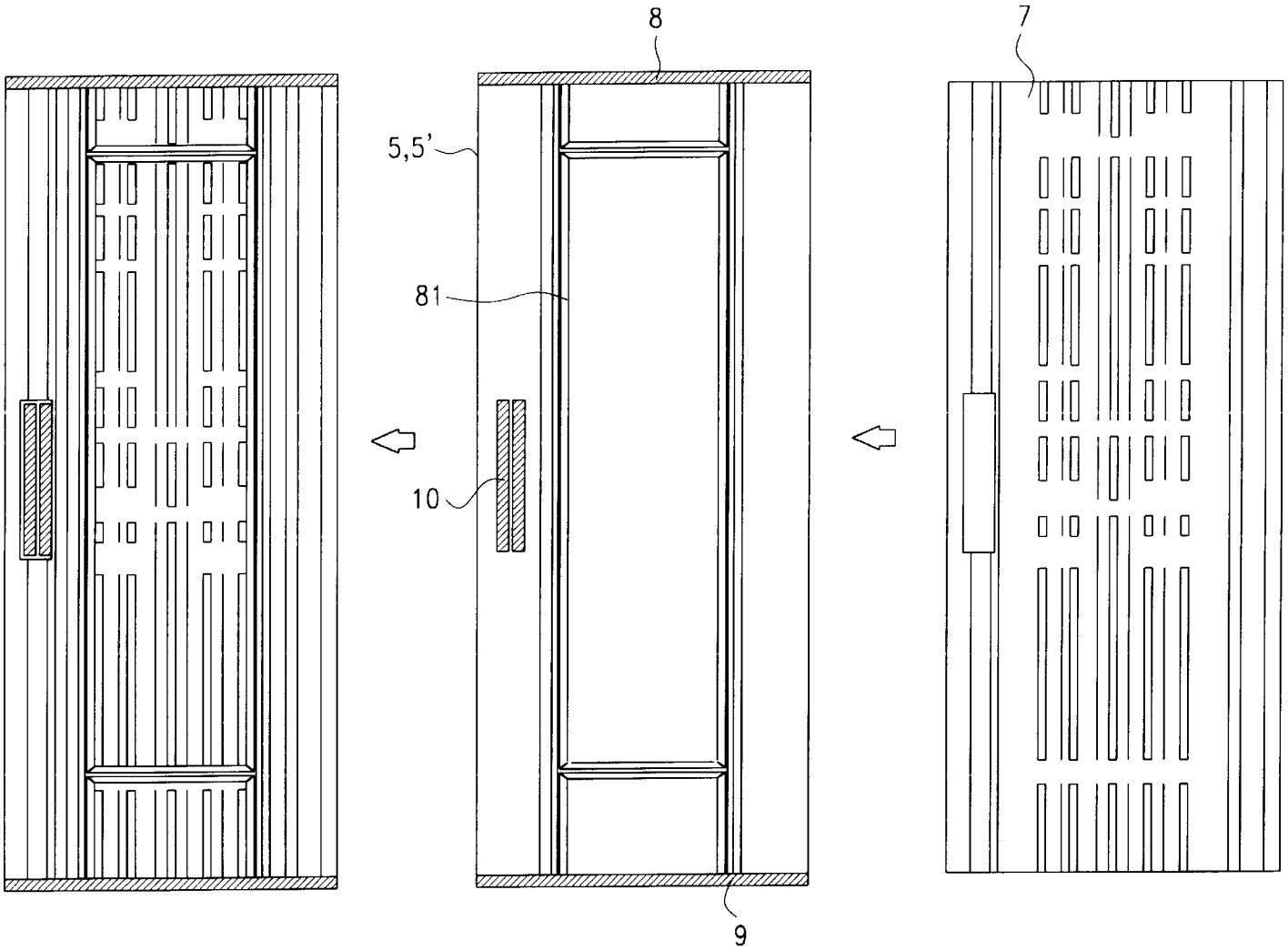
FIG. 9 shows a third embodiment of the door assembly drawing (type C) with matching door panels.

FIG. 1 is a section view of an extruded plastic interior reinforcing material wherein the material used is PVC (polyvinyl chloride) having two concave areas or grooves 13 of 2.2 mm width and 4.5 mm depth on each of two sides thereof. The grooves are inserted with the ribs 121, 121' (in FIGS. 5, 6) on two sides of a door panel (FIGS. 7, 8, 9). The right and left stiles 5, 5' are fitted into grooves 13 with a flexible-rigid co-extrusion convex part or tongue 12, 12' (as shown in FIGS. 3, 4). In addition, there is a hollow convex structure or stiffener 18 of reinforcing material to support the door panel 71, 81, 91 (FIGS. 1, 7, 8, 9) and to provide strength at a certain distance along the width of the door.

Figure 2:
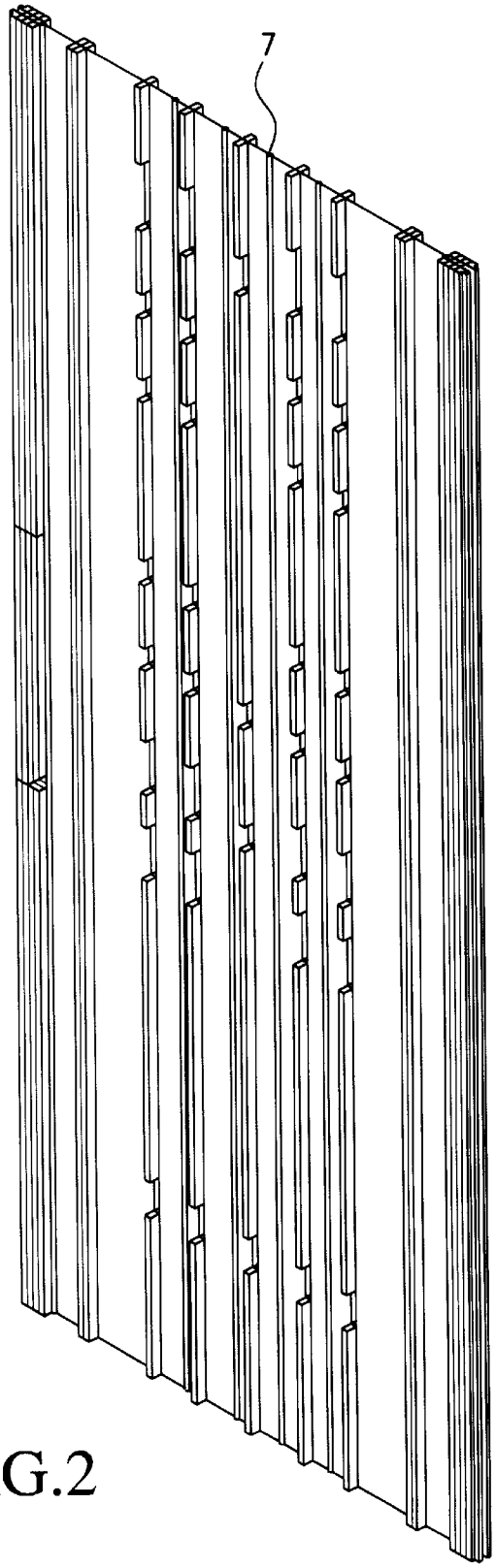
FIG. 2 is a perspective drawing of the reinforcing material.

FIG. 2 is a perspective view of an extruded plastic interior reinforcement material 7 having an opening of 80 mm width and 400 mm length cut in its side for receiving a handle 10 (as shown in FIGS. 7, 8, 9). The hollow reinforcement convex structure 18 can be matched with various types of door panels 71, 81, 91 (FIGS. 7, 8, 9).

FIG. 3 is a perspective view of a first embodiment (type 1) of the left and right stiles 5, wherein a middle part of the stile's "T"-shaped appearance includes a tongue 12 having a lip 121 on both sides thereof that will be tightly glued to the door panel 71, 81, 91 (FIGS. 7, 8, 9) and interior reinforcement material (FIGS. 7, 8, 9) so as to form a stile structure of 6 mm width.

FIG. 4 is the perspective view of a second embodiment of left and right stiles 5' (type 2), wherein the middle part of the stile's "T"shaped appearance is a tongue 12' having a lip 121' at both sides thereof that will be tightly glued to the door panel 71, 81, 91 (FIGS. 7, 8, 9) and the interior material 10 (FIGS. 7, 8, 9), so as to form a stile structure of 10 mm width.

Figure 5A:
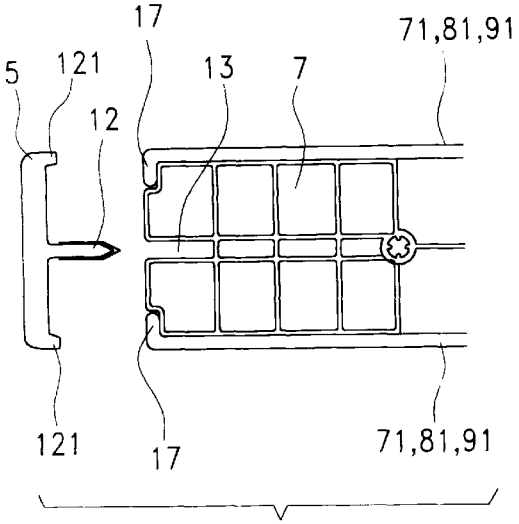
FIGS. 5A and 5B show the first embodiment left and right stiles (type 1), door panel, and interior reinforced material before and after assembly.
Figure 5B:
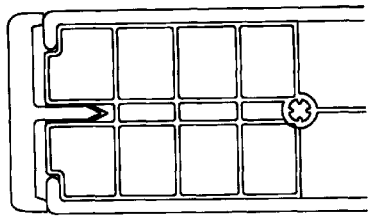

FIG. 5A is a cross-sectional view (type 1 styles) before assembly of left and right stiles 5 showing their location with respect to the door panel 71, 81, 91, ribs 17, and the interior reinforced material. The concave part 13 of the interior reinforced material is designed to be tightly glued with the tongue 12 of the left and right stiles 5. FIG. 5B shows the relative positions of the door panels 71, 81, 91, and the interior reinforced material 7 after assembly.

Figure 6A:
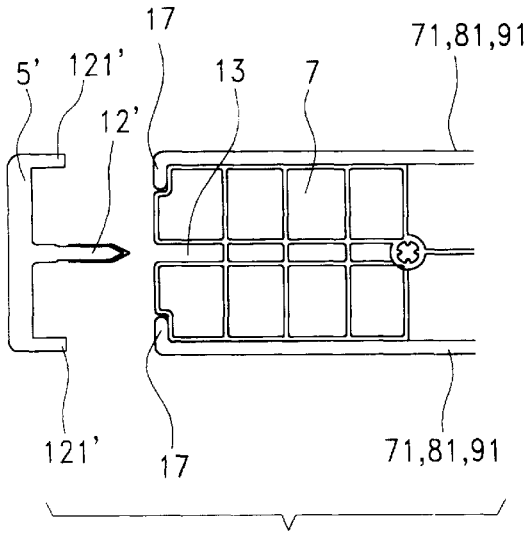
FIGS. 6A and 6B show the second embodiment left and right stiles (type 2), door panel and interior reinforced material before and after assembly.
Figure 6B:
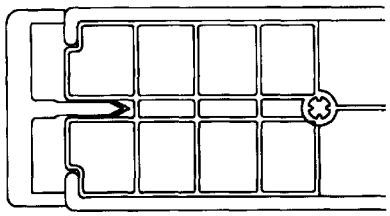

FIG. 6A shows the relative positions of the door panel 71, 81, 91 having ribs 17, the interior reinforced material 7 in the second embodiment of the left and right stiles 5' before assembly. The concave part 13 of the interior reinforced material is designed to be tightly glued with the flexible-rigid co-extrusion convex part of the left and right stiles 5'. FIG. 6B shows the relative positions of the door panels 71, 81, 91 and the interior reinforced material 7 after assembly.

FIG. 7 shows the relative positions of a first embodiment of a door assembly drawing (type A) matching with a door panel. The assembly steps for this embodiment are as follows:

(1) Assemble the interior of door panel 71 having ribs 17 (FIGS. 5, 6);

(2) Apply glue to every connected area;

(3) Put the interior reinforced material 7, handle reinforcement 10 and the top and bottom structural members 8, 9 on the door panel;

(4) Apply glue to the required areas of another door panel;

(5) Affix the left and right stiles inside two door panels 5, 5';

(6) Wait for the glue to dry and finish the assembling steps.

The top and bottom structural members 8, 9 could be wood, plastic injection moldings, or extrusion moldings.

FIG. 8 shows the relative positions for a second embodiment of the door assembly (type B) being matched with another door panel. The assembly steps are as follows:

(1) Assemble the interior of door panel 81 having ribs 17 (FIGS. 5, 6) on two sides;

(2) Apply glue to every connected area;

(3) Put the interior reinforced material 7, handle reinforcement 10, and the top and bottom structural members 8, 9 on the door panel;

(4) Apply glue to the required areas of another door panel;

(5) Affix the left and right stiles 5, 5' inside two door panels 71, 81, 91;

(6) Wait for the glue to dry and finish the assembling process.

The top and bottom structural members 8, 9 could be wood, plastic injection moldings, or extrusion moldings.

FIG. 9 shows the relative positions of a third embodiment of a door assembly (type C) being matched with another door panel. The assembly steps are as follows:

(1) Assemble the interior of door panel 81 having ribs 17 (FIGS. 5, 6) on two sides;

(2) Apply glue to every connected area;

(3) Put the interior reinforced material 7, handle reinforcement 10, and the top and bottom structural members 8, 9 on the door panel;

(4) Apply glue to the required areas of another door panel;

(5) Affix the left and right stiles 5, 5' inside two door panels 71, 81, 91;

(6) Wait for the glue to dry and finish the assembling process.

The top and bottom structural members 8, 9 could be wood, plastic injection moldings, or extrusion moldings.

Figure 10:
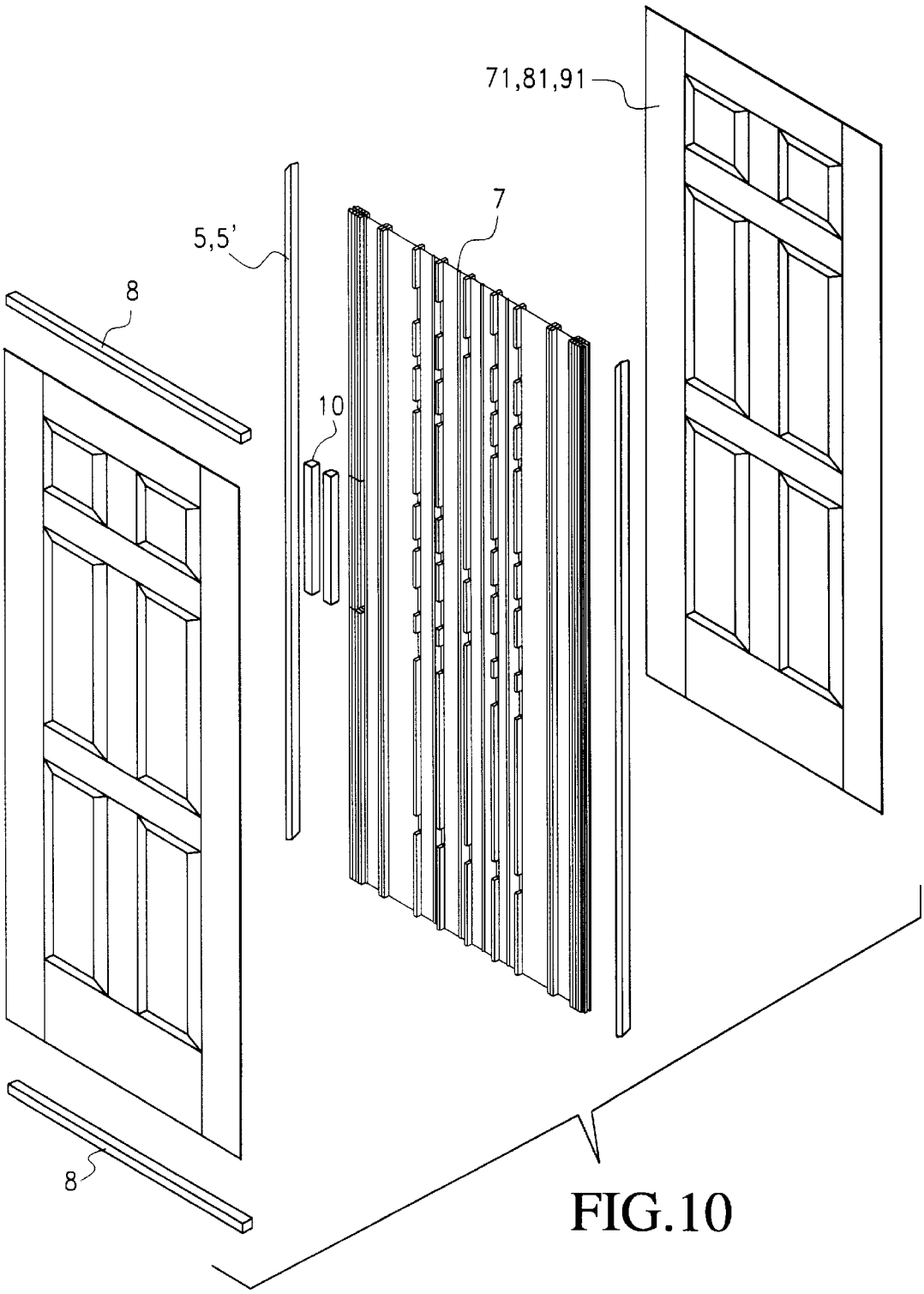
FIG. 10 is an exploded view of the door assembly shown in FIG. 8.

FIG. 10 is an exploded isometric view of the door construction of FIGS. 7–9. In this embodiment, the extruded plastic interior reinforced material 7 acts as the primary body structure of the door. The door is covered with door panels 71, 81, 91 having ribs on two sides thereof. Reference numerals 5, 5' are T-shaped portions of the left and right stiles. Reference numerals 8, 9 are top and bottom structural members which create a closed space with the left and right stiles 5, 5'.

Figure 11:
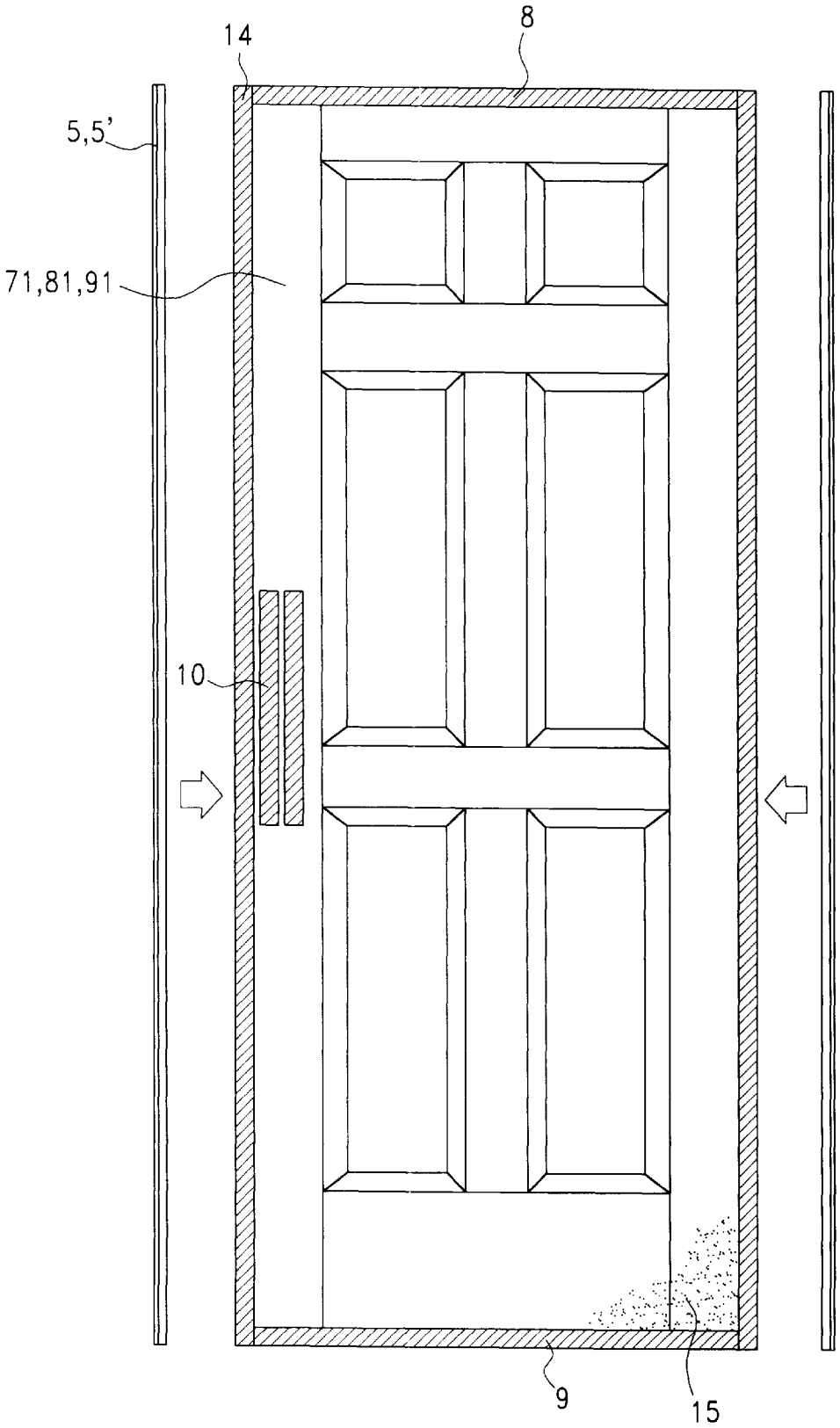
FIG. 11 is an assembly view of a polyurethane-filled door.

FIG. 11 is an assembly drawing showing the filling of polyurethane into the door. The steps are as follows:

(1) Assemble the interior of door panel 71, 81, 91 having ribs at two sides;

(2) Apply glue to every connected area;

(3) Put the left and right reinforced structural members 14 having groove shape at sides, handle reinforcement 10 and the top and bottom structural members 8, 9 on the door panel;

(4) Apply glue to the required areas of another door panel;

(5) Affix the left and right stiles 5, 5' inside two door panels 71, 81, 91;

(6) Wait for the glue to dry and finish the assembling process;

(7) Drill a hole in the bottom stile and fill the door with polyurethane.

Figure 12:
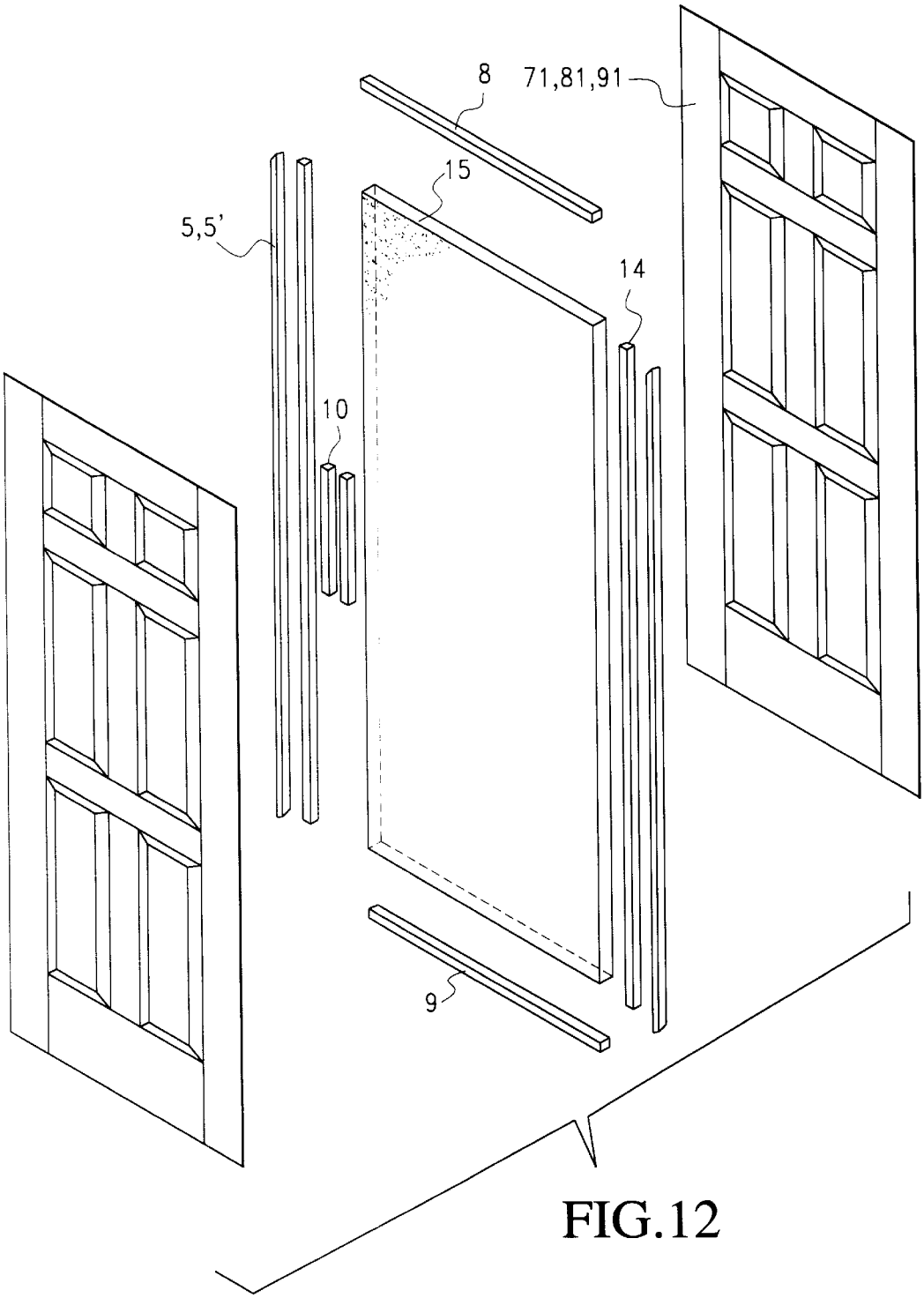
FIG. 12 is an exploded view of the door as shown in FIG. 11.

FIG. 12 is an exploded isometric drawing of the door filled with polyurethane. The polyurethane 15, and the left and right reinforced structural members 14 having a groove shape on each side thereof, constitute the primary body structure of the door. The handle reinforcement 10 is a rectangular solid that is covered with door panels 71, 81 and 91. The T-shaped portions of the left and right stiles 5, 5', and the top and bottom structural members 8, 9, form a closed space.

FIGS. 13A–13D show the relative positions; among the various embodiments with filled polyurethane 15 filling. The left and right reinforced structural members 14 has a 3.6 mm width and a 12 mm depth. The door panels 71, 81, 91 have ribs on both sides thereof, and the left and right stiles 5, 5' have a tongue 12, 12'.

The embodiment illustrated in FIGS. 13A–13D includes:

(1) two door panels 71, 81, 91 having ribs on both sides;

(2) an extruded plastic interior reinforced material 7;

(3) two extruded plastic left and right stiles 5, 5' which can be 6 mm or 10 mm width, as required;

(4) two top and bottom structural members 8, 9; and (5) a handle reinforcement 10.

The extruded plastic interior material 7 supports door panels 71, 81, 91 having ribs on both sides that are glued and fixed together with each other. Since the reinforcing material is rigid PVC, there are convex hollow structures appropriately spaced in support of door panels. This single molded structure can reinforce the door strength, facilitate the assembling process, reduce product defects, and reduce inefficiencies caused by the reinforced materials being scattered and assembled individually, thus causing a waste of time and cost, and lack of strength.

The left and right stiles 5, 5' are made of PVC using co-extrusion techniques during which the tongues 12, 12' are inserted in the grooves 13 of the left and right structural members 14 to create a strong construction without gluing. Further, the rigid PVC is easy to modify and therefore can be used to meet special requirements for the door or frame by changing dimensions to prevent the defects caused by overflowing glue in conventional structures and difficult partial modification.

Figure 13C:
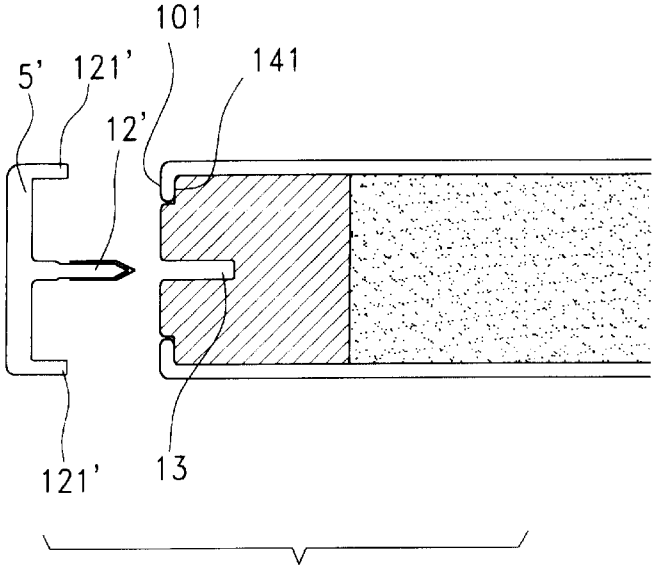
FIGS. 13A–13D show the left and right stiles, door panels, and left and right reinforcing materials for a polyurethane-filled door before and after the stiles are inserted into the reinforcing materials.
Figure 13D:
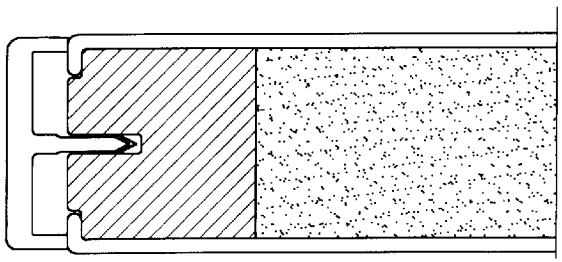
Figure 13A:
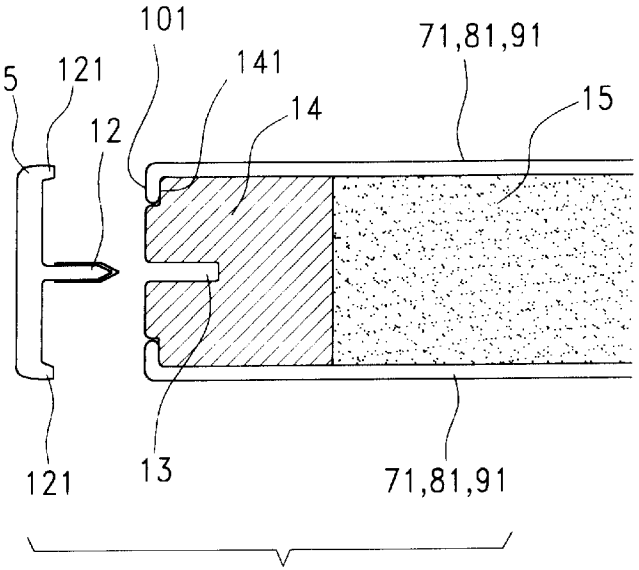
Figure 13B:
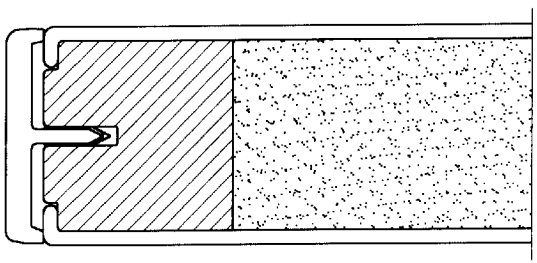

The door panels 71, 81, 91 each have curved end portions 101, and each of the left and right structural members 14 including a pair of recessed portions 141 that receive a respective one of the curved end portions 101 of the door panels 71, 81, 91, as shown in FIGS. 13A and 13C. The curved end portions 101 are substantially perpendicular to the tongues 12, 12' of the T-shaped left and right stiles 5, 5'.

Another model of this invention is that the left and right reinforced structural members 14 have groove shapes that are joined together with the convex parts of the left and right stiles 5, 5'. They are then matched with the top and bottom stiles and two door panels to form a closed space. After that, a hole is drilled in the bottom stile for filling the inner part with polyurethane and forming an imitation wood texture door.

This invention can be made with different dimensions of door width as required. The manufacturing method uses an extruded plastic interior reinforced material 7 with top and bottom structural members and two door panels forming a closed space. The door may be cut to the require width after gluing together. A groove is then cut on both sides to receive left and right stiles that are inserted in the reinforcing structure and fitted with an imitation wood grain door.

For the preceding method, the extruded plastic interior reinforcing material can be replaced by polyurethane filling to increase the flexibility and provide for multiple patterns.

Generally, the raw material of door can be either thermosets or thermoplastics. During the manufacturing process with thermosets, an FRP (fiber reinforced plastic) additive is not required. The door can also be recycled for other purposes to fulfill the requirement of environmental protection. By adding $Al(OH)_3$ during the compounding, it can be fireproofed for safety. If this door replaces a wooden door, it can reduce wood consumption in a large amount, and thus protect the precious resource of forests.

In summary, this creation can save many manufacturing steps, simplify assembling procedures, and reduce manpower cost. This door structure is also easily cuttable and moisture-proof to prevent door bending. Therefore, the inventive door is useful, economic and creative, and can promote product quality, and as a result, is novel and non-obvious.

Although preferred embodiments have been disclosed, other embodiments and modifications of the invention are intended to be covered by the spirit and scope of the appended claims.

What I claimed is:

1. A press-molded door comprising:

top, bottom, right, and left structural members secured together to form a substantially rectangular support structure, the right and left structural members comprising extruded rigid Polyvinyl Chloride material;

front and back panels arranged on opposite sides of the rectangular support structure to substantially enclose the rectangular support structure, the front and back panels each having curved end portions;

polyurethane filling arranged to fill the inside of the rectangular support structure between the front and back panels;

a groove formed along the length of an edge face of each of the right and left structural members between the top and bottom structural members, each of the left and right structural members including a pair of recessed portions that receive a respective one of the end portions of the front and back panels; and a T-shaped stile comprising a tongue that is secured by a compression-fit in each of said grooves of the right and left structural members, the T-shaped stiles each comprising a pair of ribs that extend in a direction parallel to the tongue and are attached to respective ones of the front and back panels at the curved end portions of the respective front and back panels, the curved end portions are substantially perpendicular to the tongues of the T-shaped styles, the T-shaped stiles configured along the length of respective ones of the left and right structural members, and the T-shaped stiles comprising extruded Polyvinyl Chloride Material.

2. The press-molded door as claimed in claim 1, further comprising a pair of air gaps formed between the tongue and ribs of each of the T-shaped stiles.

3. The press-molded door as claimed in claim 1, further comprising a handle reinforcement imbedded between the right and left structural members.

* * * * *